US011406199B2

(12) United States Patent
Suttie et al.

(10) Patent No.: US 11,406,199 B2
(45) Date of Patent: Aug. 9, 2022

(54) SEAT AND CRIB ARRANGEMENT

(71) Applicant: PENNSUTT LIMITED, Edinburgh (GB)

(72) Inventors: John Suttie, Edinburgh (GB); June Pennykid, Edinburgh (GB); Alan Suttie, Edinburgh (GB); Thomas Blakeman, Edinburgh (GB)

(73) Assignee: PENNSUTT LIMITED, Edinburgh (GB)

( * ) Notice: Subject to any disclaimer, the term of this patent is extended or adjusted under 35 U.S.C. 154(b) by 0 days.

(21) Appl. No.: 16/755,557

(22) PCT Filed: Oct. 12, 2018

(86) PCT No.: PCT/GB2018/052952

§ 371 (c)(1),
(2) Date: Apr. 10, 2020

(87) PCT Pub. No.: WO2019/073268

PCT Pub. Date: Apr. 18, 2019

(65) Prior Publication Data

US 2021/0186232 A1 Jun. 24, 2021

(30) Foreign Application Priority Data

Oct. 13, 2017 (GB) ..... 1716837

(51) Int. Cl.

| | |
|---|---|
| ***A47D 1/02*** | (2006.01) |
| ***A47D 1/00*** | (2006.01) |
| ***A47D 9/00*** | (2006.01) |

(52) U.S. Cl.

CPC ..... *A47D 1/023* (2017.05); *A47D 1/006* (2013.01); *A47D 1/0085* (2017.05); *A47D 9/00* (2013.01)

(58) Field of Classification Search

None

See application file for complete search history.

(56) References Cited

U.S. PATENT DOCUMENTS 2,121,100 A * 6/1938 Rosenbaum ..... A47C 17/17 297/244

2,488,225 A * 11/1949 Mover ..... A47D 1/00 297/8

(Continued)

FOREIGN PATENT DOCUMENTS

| | | |
|---|---|---|
| CN | 105774883 | 7/2016 |
| FR | 2323357 | 4/1977 |

(Continued)

OTHER PUBLICATIONS

International Search Report for International Application No. PCT/GB2018/052952.

(Continued)

*Primary Examiner* — David E Allred

(74) *Attorney, Agent, or Firm* — Liu & Liu

(57) ABSTRACT

The present invention relates to an infant seat and crib arrangement (10). The infant seat and crib arrangement (10) comprises a seat (14) configured to support an infant in a sitting position, a crib configured to enclose an infant and a frame (12). The frame (12) is configured for change between a first disposition in which the seat (14) engages removably with the frame to thereby bring the seat into use and a second disposition in which the crib removably engages with the frame to thereby bring the crib into use.

18 Claims, 9 Drawing Sheets

(56) References Cited

U.S. PATENT DOCUMENTS

| | | | | |
|---|---|---|---|---|
| 2,709,478 | A | 5/1955 | Golding et al. | |
| 2,730,163 | A * | 1/1956 | Goldberg | B60N 2/2854 297/8 |
| 2,754,889 | A * | 7/1956 | Lovelace | A47D 1/06 297/118 |
| 2,846,700 | A | 5/1957 | De Puy | |
| 3,115,364 | A * | 12/1963 | Berlin | B60N 2/2833 297/130 |
| 4,205,669 | A | 6/1980 | Hamann | |
| 4,455,697 | A * | 6/1984 | Rovida | A47D 7/002 256/25 |
| 4,671,566 | A * | 6/1987 | Knapp | A47C 4/42 248/188.6 |
| D332,882 | S | 2/1993 | Graves | |
| D357,828 | S | 5/1995 | Liao | |
| D366,967 | S | 2/1996 | Meeker et al. | |
| 6,006,376 | A * | 12/1999 | Williamson | A61G 7/1015 5/81.1 R |
| 6,089,653 | A | 7/2000 | Hotaling et al. | |
| D436,465 | S | 1/2001 | Berkman | |
| D473,384 | S | 4/2003 | Ingles | |
| 7,017,924 | B1 * | 3/2006 | Lambert | A47D 1/0085 280/87.051 |
| 8,240,765 | B2 | 8/2012 | Kennedy et al. | |
| D737,063 | S | 8/2015 | Lin et al. | |
| 9,693,636 | B2 | 7/2017 | Yang | |
| D810,488 | S | 2/2018 | Riggs et al. | |
| 2008/0034498 | A1 * | 2/2008 | Chen | A47D 13/063 5/99.1 |
| 2008/0290699 | A1 * | 11/2008 | Golias | A47D 1/023 297/16.1 |
| 2011/0067181 | A1 | 3/2011 | Luzzi | |
| 2013/0285421 | A1 | 10/2013 | Huntsberger et al. | |
| 2014/0014791 | A1 | 1/2014 | Shan | |
| 2014/0054938 | A1 | 2/2014 | Shan | |
| 2014/0183843 | A1 * | 7/2014 | Iftinca | B62B 9/104 280/647 |
| 2014/0319884 | A1 * | 10/2014 | Doucette | B62B 7/00 297/118 |
| 2015/0359354 | A1 | 12/2015 | Greger | |
| 2016/0007766 | A1 | 1/2016 | Sack et al. | |
| 2016/0037941 | A1 | 2/2016 | Windenberger | |
| 2017/0188709 | A1 * | 7/2017 | Bergling | A47D 9/005 |
| 2017/0238721 | A1 * | 8/2017 | Damiani | A47D 7/02 |
| 2017/0251826 | A1 | 9/2017 | Sclare et al. | |
| 2019/0059609 | A9 | 2/2019 | Sclare et al. | |
| 2020/0165870 | A1 | 5/2020 | Moss et al. | |
| 2020/0170419 | A1 | 6/2020 | Sclare et al. | |
| 2021/0037989 | A1 * | 2/2021 | Rogers | A47C 12/02 |

FOREIGN PATENT DOCUMENTS

| | | | | |
|---|---|---|---|---|
| GB | 190719775 | A * | 6/1908 | |
| GB | 190719362 | A * | 7/1908 | |
| GB | 258398 | A * | 9/1926 | A47D 1/002 |
| GB | 2186793 | | 8/1987 | |
| WO | 2011106855 | | 9/2011 | |
| WO | WO-2020227782 | A1 * | 11/2020 | A47D 1/008 |

OTHER PUBLICATIONS

Certificate of Registration for EP Registered Community Design No. 001919101-0002, Registration Date Sep. 18, 2011, Babies' Chairs, pp. 1-3.

* cited by examiner

SEAT AND CRIB ARRANGEMENT

FIELD OF THE INVENTION

The present invention relates to a seat and crib arrangement for a young child and in particular for an infant.

BACKGROUND ART

Caring for an infant typically involves use of different equipment at different times depending on the infant's needs, such as feeding, sleeping or dressing, or the age of the infant. The carer therefore often acquires and stores several pieces of equipment with each piece of equipment being brought into use as the need arises. Storage of several pieces of equipment may take up an undesirable or undue amount of space in the home. Multifunctional infant care equipment has therefore been devised.

The present inventors have recognised known multifunctional infant care equipment to have shortcomings. The present invention has been devised in the light of the inventors' appreciation of such shortcomings. It is therefore an object for the present invention to provide a seat and crib arrangement which is configured for use by a young child and in particular by an infant.

STATEMENT OF INVENTION

According to a first aspect of the present invention there is provided an infant seat and crib arrangement comprising:

- a seat configured to support an infant in a sitting position;
- a crib configured to enclose an infant; and
- a frame configured for change between a first disposition in which the seat engages removably with the frame to thereby bring the seat into use and a second disposition in which the crib removably engages with the frame to thereby bring the crib into use.

The infant seat and crib arrangement comprises a seat configured to support an infant in a sitting position and a crib configured to enclose an infant, for example when the infant is lying in the crib. The infant seat and crib arrangement further comprises a frame configured for change between a first disposition and a second disposition. When the frame is in the first disposition the seat engages removably with the frame to thereby bring the seat into use. The seat and the frame may be configured for releasable attachment of seat to frame. When the frame is in the second disposition the crib engages removably with the frame to thereby bring the crib into use. The crib and the frame may be configured for releasable attachment of crib to frame. The carer may therefore put the frame in the first disposition and then attach the seat to the frame. When the infant no longer has need of use of the seat, the carer may detach the seat from the frame, change the frame to the second disposition and attach the crib to the frame. The crib may then be used by the infant. Thereafter the infant seat and crib arrangement may be changed back to the first disposition when the seat is to be brought back into use.

The frame may comprise first and second pairs of legs and first and second pairs of arms, the first pair of arms being adjacent the first pair of legs and the second pair of arms being adjacent the second pair of legs, a space for receiving either the seat or the crib being defined between the first pairs of arms and legs and the second pairs of arms and legs.

The frame may be configured for relative rotation of the arms in each of the first and second pairs of arms whereby distal ends of the arms in each pair are spaced apart further from each other in the second disposition than in the first disposition. More specifically, arms in each of the first and second pairs of arms may define an acute angle between each other when in the first disposition and may extend substantially in a line when in the second disposition. The arms may thus be rotated from the first disposition, in which they are folded away to allow unimpeded use of the seat, to the second disposition in which they extend in a line and thereby provide support for an upper end of a crib.

In the first and second dispositions, the legs in the first pair of legs may slope away from a first apex, the legs in the second pair of legs may slope away from a second apex, the arms in the first pair of arms may extend away from the first apex, and the arms in the second pair of arms may extend away from the second apex. As mentioned above, the first and second pairs of legs may be spaced apart from each other. The first and second apexes may therefore be spaced apart across ground on which the frame is supported on distal ends of the first and second pairs of legs. In the first disposition, the arms in the first pair of arms legs may slope away from the first apex in alignment with the first pair of legs and the arms in the second pair of arms may slope away from the second apex in alignment with the second pair of legs. Respective arms and legs may overlie each other in the first disposition. In the second disposition, arms in the first pair of arms may extend in substantially opposite directions from the first apex and arms in the second pair of arms may extend in substantially opposite directions from the second apex.

Arms of the first and second pairs of arms opposing each other across the seat or crib receiving space may be attached to each other by a respective elongate arm member. Therefore when an arm of a pair of arms is moved the opposing arm moves also. Furthermore, the elongate arm member may define part of an upper extent of the frame from which the crib depends when in the second disposition. The arms of the first and second pairs of arms and the two elongate arm member may define a substantially rectangular structure from which the crib depends.

Legs of the first and second pairs of legs opposing each other across the seat or crib receiving space may be attached to each other by a respective elongate leg member, each elongate arm member and each elongate leg member being extensible. The space between the first pairs of arms and legs and the second pairs of arms and legs may thus be changed with a closer spacing for receiving the seat and a wider spacing for receiving the crib.

The frame may comprise first and second hinges, the first hinge being at the first apex and providing for relative rotation of arms in the first pair of arms and the second hinge being at the second apex and providing for relative rotation of arms in the second pair of arms.

The frame may be configured such that the first hinge provides for relative rotation of the legs in the first pair of legs and the second hinge provides for relative rotation of the legs in the second pair of legs whereby distal ends of the legs in each pair of legs are spaced apart from each other further in the second disposition than when in the first disposition. Closer spacing of legs within the pairs of legs when in the first disposition may provide sufficient support and appropriate spacing of legs for use of the seat and wider spacing of legs within the pairs of legs when in the second disposition may define a larger area appropriate for support of the crib.

Each of the first and second hinges may be configured such that rotation of an arm in a pair of arms causes rotation of the adjacent leg, the leg rotating to a lesser extent than the arm whereby an acute angle is defined between the arm and the leg when in the second disposition.

The frame may be changeable between the first and second dispositions by way of a hinge arrangement. The hinge arrangement may comprise the first and second hinges described above. The first and second hinges may provide for rotation around substantially the same axis. The frame may comprise a floor supporting part which is defined by distal ends of the legs. The frame may be configured such that when the frame is supported on the floor by the floor supporting part the hinge arrangement may be towards an upper end of the frame, i.e. towards a part of the frame furthest apart from the floor on which the frame is supported. The first and second hinges may be spaced apart such that they rotate about an axis generally and more specifically substantially parallel to a plane in which the floor supporting part lies.

As described above, first and second legs in each pair may be spaced apart from each other, and one of the seat and the crib may be received between the first and second legs of each pair of legs. The first legs of the first and second pairs of legs may define a first side of the frame. The first legs may lie in a first plane. The second legs of the first and second pairs of legs may define a second side of the frame. The second legs may lie in a second plane. The first and second planes may be generally and more specifically substantially parallel. Each of the first and second planes may extend generally and more specifically substantially orthogonal to a plane in which the floor supporting part lies. A width of the frame may therefore be determined by a distance between the first legs and between the second legs.

The first legs of the first and second pairs of legs may be mechanically coupled to each other towards their first proximal ends. Second distal ends of the first legs of the first and second pairs of legs may each define a floor supporting surface, for example, on an end thereof. The floor supporting surface may bear against the floor when the infant seat and crib arrangement is in use whereby the infant seat and crib arrangement is supported on the floor. As described above, a separation between the first legs of the first and second pairs of legs may increase progressively from the proximal ends to the distal ends. The second legs of the first and second pairs of legs may comprise one or more features of the first legs of the first and second pairs of legs described in the present paragraph.

The first and second legs in each of the first and second pairs of legs may be mechanically coupled to each other. More specifically the first and second legs in each pair may be rigidly coupled to each other whereby movement of one of the first and second legs between the first and second dispositions, as described further below, causes corresponding movement of the other of the first and second legs. The frame may thus be configured such that the first and second legs move together. The first and second legs in each pair may be coupled to each other by the elongate leg member described above which extends between the first and second legs and attaches to the first and second legs at opposite ends of the leg member. The elongate leg member may be attached towards distal ends of the first and second legs. The elongate leg member may therefore extend across a floor on which the frame is supported when in use. As described above, the elongate leg member may be configured to change its length whereby a separation between the first legs of each pair and the second legs of each pair may be changed.

The first legs of the first and second pairs of legs may be mechanically coupled to each other for relative movement and more specifically relative rotation, such as by way of the hinge described above. The hinge may be towards an upper end of the frame when the frame is supported on a floor. A separation between the distal ends of the first legs may thus be changed. The second legs of the first and second pairs of legs may be mechanically coupled in a corresponding fashion whereby a separation between the distal ends of the second legs may be changed.

Relative rotation may provide for movement of the legs between: a collapsed disposition further to the first and second dispositions in which the distal ends of the first and second pairs of legs are adjacent whereby the frame occupies less space and may be stored more readily; and one of the first and second dispositions in which the distal ends of the first and second pairs of legs are spaced apart whereby the frame may be brought into use with the seat or the crib.

As described above, the frame may further comprise first and second pairs of arms. Each of the first and second pairs of arms may comprise a first arm and a second arm. One of the seat and the crib may be received between the first and second arms of each pair of arms. The first and second pairs of arms may be coupled for movement relative to the rest of the frame between a first arm disposition in which the arms extend obliquely towards the floor when the frame is in use and a second arm disposition in which the arms extend generally parallel to and more specifically substantially parallel to the floor when the frame is in use. The frame may be configured such that in the first arm disposition the arms in the first pair of arms are side by side and more specifically adjacent with a respective leg in the first pair of legs. The frame may be configured such that in the first arm disposition the arms in the second pair of arms are side by side and more specifically adjacent with a respective leg in the second pair of legs. An arm side by side with a leg may be substantially coterminous with the leg in respect of their respective sides and having regard to whatever difference in their lengths there may be. The frame may be configured such that each arm is inside its respective leg whereby an outside width of the frame is defined by the legs. The frame may be configured such that in the second arm disposition the arms are above the legs.

The first arms of the first and second pairs of arms may be mechanically coupled to each other towards their first proximal ends. The second arms of the first and second pairs of arms may be mechanically coupled to each other towards their first proximal ends. The first and second pairs of arms may be coupled for rotation relative to the rest of the frame. The first and second pairs of arms may be coupled towards their first proximal ends for rotation relative to each other. The first arms of the first and second pairs of arms may be coupled for relative rotation by way of the hinge described above. The second arms of the first and second pairs of arms may be coupled for relative rotation towards their first proximal ends. The second arms of the first and second pairs of arms may be coupled for relative rotation by way of a hinge. Where legs of the frame are coupled for rotation by way of a hinge, the hinge may be further configured for rotation of arms. The infant seat and crib arrangement may therefore comprise two spaced apart hinges, each hinge providing for rotation of a respective one of first arms and legs and second arms and legs.

The first and second arms in each of the first and second pairs of arms may be mechanically coupled to each other. More specifically the first and second arms in each pair may be rigidly coupled to each other whereby movement of one of the first and second arms between the first and second dispositions, as described further below, causes corresponding movement of the other of the first and second arms. The first and second arms may therefore move together. The first and second arms in each pair may be coupled to each other by way of the elongate arm member described above which extends between the first and second arms and attaches to first and second arms at opposite ends of the arm member. The elongate arm member may be attached towards distal ends of the first and second arms. The elongate arm member may therefore extend across a floor on which the frame is supported when in use. The elongate arm member may be configured to change its length whereby a separation between the first arms in each pair and the second arms in each pair may be changed. A width of the frame may thus be changed. When the elongate arm member is shorter such that the frame is less wide the frame may be configured for use with the seat. When the elongate arm member is longer such that the frame is wider the frame may be configured for use with the crib.

As described above, the arms and legs may be rotatable by way of the same hinge arrangement. The frame may be configured such that the legs are in the first extended disposition when the arms are in the first arm disposition whereby the infant seat and crib arrangement is in the first disposition in which the seat engages removably with the frame. The hinge arrangement may be configured such that when the arms are rotated upwards from the first arm disposition to the second arm disposition, upward rotation of the arms is accompanied by rotation of the legs from the first extended disposition to the second extended disposition.

The hinge arrangement may be configured such that force applied to move the arms from the first arm disposition to the second arm disposition is coupled to the legs to thereby move the legs from the first extended disposition to the second extended disposition. At least one leg and at least one arm may comprise respective profiles comprised in the hinge arrangement which cooperate to couple force applied to the arms from the arms to the legs. A leg may comprise a first profile and an arm may comprise a second profile. The first and second profiles may be configured such that upward rotation of the arms from the first arm disposition causes the first profile to abut against a part of the second profile whereby force causing upwards rotation of the arms is coupled to the legs to thereby rotate the legs from the first extended disposition to the second extended disposition. The legs may therefore move with the arms when the latter are moved towards the second arm disposition. When the legs are in the second extended disposition the hinge arrangement may be configured such that the arms move further apart until they are in the second arm disposition. The first and second profiles may be configured accordingly whereby force which moves the arms further apart is no longer coupled from the arms to the legs. When the arms are rotated in the opposite direction, for example, such that the frame is put in the collapsed disposition, the first and second profiles move relative to each other without force being coupled from the arms to the legs.

The hinge arrangement may comprise a finger which is mounted on a leg and which defines a protrusion. The leg other than the leg mounting the finger may define at least two spaced apart leg recesses, each recess being configured to receive the protrusion. A first leg recess may receive the protrusion when in the first disposition. A second leg recess may receive the protrusion when in the second disposition. Where the frame may be configured to have a collapsed disposition, a third leg recess may receive the protrusion when in the collapsed disposition. One of the arms may define a first recess configured to receive the protrusion. The first recess may be disposed to receive the protrusion when the frame is in the second disposition. The other arm may define second and third recesses which are spaced apart, each recess being configured to receive the protrusion. The second recess may be disposed to receive the protrusion when the frame is in the second disposition. The third recess may be disposed to receive the protrusion when the frame is in the collapsed disposition. The frame may thus be maintained in each of the first, second and collapsed dispositions by way of reception of the protrusion in a respective recess.

The finger may be configured for movement of the protrusion into and out of a recess. The hinge may therefore be unlocked by withdrawing the protrusion from a recess when it is desired to change the frame from one disposition to another disposition. The protrusion may be biased, such as by way of a spring coupled to the finger, towards being received in a recess. The protrusion may be removed from a recess by manual operation of the finger. Alternatively or in addition, the protrusion may be removed from a recess by way of cooperation of the protrusion with a hinge profile defined in the hinge arrangement. At least one of the two arms may define a hinge profile which is shaped to push the protrusion progressively away from the hinge arrangement as the arm is raised relative to the legs and thereby remove the protrusion from a recess. Each of the two arms may define such a hinge profile, a first one of the hinge profiles being disposed to remove the protrusion from a first recess and a second one the hinge profiles being disposed to remove the protrusion from a second recess.

The infant seat and crib arrangement may further comprise a cot for an infant. In addition the frame may be configured to support the cot such that the cot is spaced apart from the floor on which the frame is supported. The cot for an infant may be a carrycot, i.e. a Moses basket. The cot for an infant may be suited for use by an infant of up to six months. Normally the seat is suited for use by an infant of six to thirty-six months and the crib is suited for use by an infant of six to twenty-four months. The present infant seat and crib arrangement may therefore be suited for use by infants not only of different ages but also of the same age in respect of different functions.

The cot may comprise two spaced apart lugs which are configured to engage with respective parts of the frame to thereby suspend the cot from the frame. The lug may comprise a lug recess which is configured to receive a part of the frame. The lug recess may be configured to receive an apex defined by the frame. The lug recess may receive the part of the frame when the frame is in the first disposition. More specifically the lug recess may receive the part of the frame when at least one of: the legs are in the first extended disposition; and the arms are in the first arm disposition. One of the seat and the cot may therefore be brought into use with the frame when the frame is in the same disposition, i.e. the first disposition. Where the frame comprises at least one arm member, the frame and the cot may be configured such that that the cot and more specifically a base of the cot is supported on the at least one arm member.

Where the frame comprises at least one member configured for change of length, such as an arm member or a leg member, each at least one member may be configured to releasably lock the member such that a particular length is maintained. The member may comprise a lock arrangement which is user operable to releasably lock the member such that a particular length is maintained. The member may comprise two portions which are movable in relation to each other whereby the length of the member may be changed. More specifically the two portions may be arranged for telescopic movement whereby the length of the member may be changed. The member may be configured such that the lock arrangement is operative to resist relative movement of the two parts. The lock arrangement may comprise a movable member, such as a ball bearing, which is movable between a first location in which the movable member mechanically couples the two parts to each other whereby their relative movement is resisted and a second location in which the movable member provides no mechanical coupling of the two parts such that they may be moved relative to each other. The lock arrangement may comprise a user operable catch which is operative before actuation to maintain the movable member in the first location and after actuation allows the movable member to move to the second location. The lock arrangement may further comprise a releasable latch which is operative to engage with the user operable catch to thereby maintain the user operable catch in the actuated disposition. The lock arrangement may be configured such that the releasable latch may disengage from the user operable catch upon movement of the two parts relative to each other and more specifically upon increase in length of the member by relative movement of the two parts. The lock arrangement may be configured such that the user operable catch is biased, such as by way of a spring, towards maintaining the movable member in the first location, the releasable latch being operative to resist biasing of the user operable catch. Disengagement of the releasable latch from the user operable catch may therefore provide for the user operable catch being biased towards maintaining the movable member in the first location whereby the lock arrangement releasably locks the member such that a different length is maintained.

The seat may comprise a unitary seat body defining a base, opposing sides and a back. The base, opposing sides and the back may define an infant receiving space. The unitary seat body may be substantially rigid. The unitary seat body may be formed from a plastics material such as a PC ABS. The seat may comprise attachment members, such as lugs, which are attached to the seat body and which are configured to engage with the frame to thereby attach the seat body to the frame. The seat may comprise a tray which is configured to be removably attached to the seat body whereby the tray is disposed in front of the infant receiving space and extends away from the infant receiving space.

The crib may comprise a crib body. The crib body may comprise pliable material such as cloth configured to define a base and sides. The base may be substantially rectangular whereby the sides comprise two pairs of opposing sides. The crib may further comprise attachment members, such as lugs, which are attached to the crib body and which are configured to attach the crib to the frame. The attachment members may be disposed on the crib body to provide for attachment to the four arms of the infant seat and crib arrangement and more specifically towards a distal end of each of the four arms.

The cot may comprise a cot body. The cot body may be formed from pliable material such as cloth. The cot body may further comprise rigid members which are disposed therein so as to determine a shape of the cot body. Where the cot comprises lugs, the lugs may be integrally formed with the cot body.

According to a further aspect of the present invention there is provided an infant seat and crib arrangement comprising: a seat configured to support an infant in a sitting position; a crib configured to support and enclose an infant; and a frame configured to support the seat and the crib in use at different times.

Embodiments of the further aspect of the present invention may comprise one or more features of the first aspect of the present invention.

BRIEF DESCRIPTION OF DRAWINGS

Further features and advantages of the present invention will become apparent from the following specific description, which is given by way of example only and with reference to the accompanying drawings, in which.

DESCRIPTION OF EMBODIMENTS

Figure 1A:
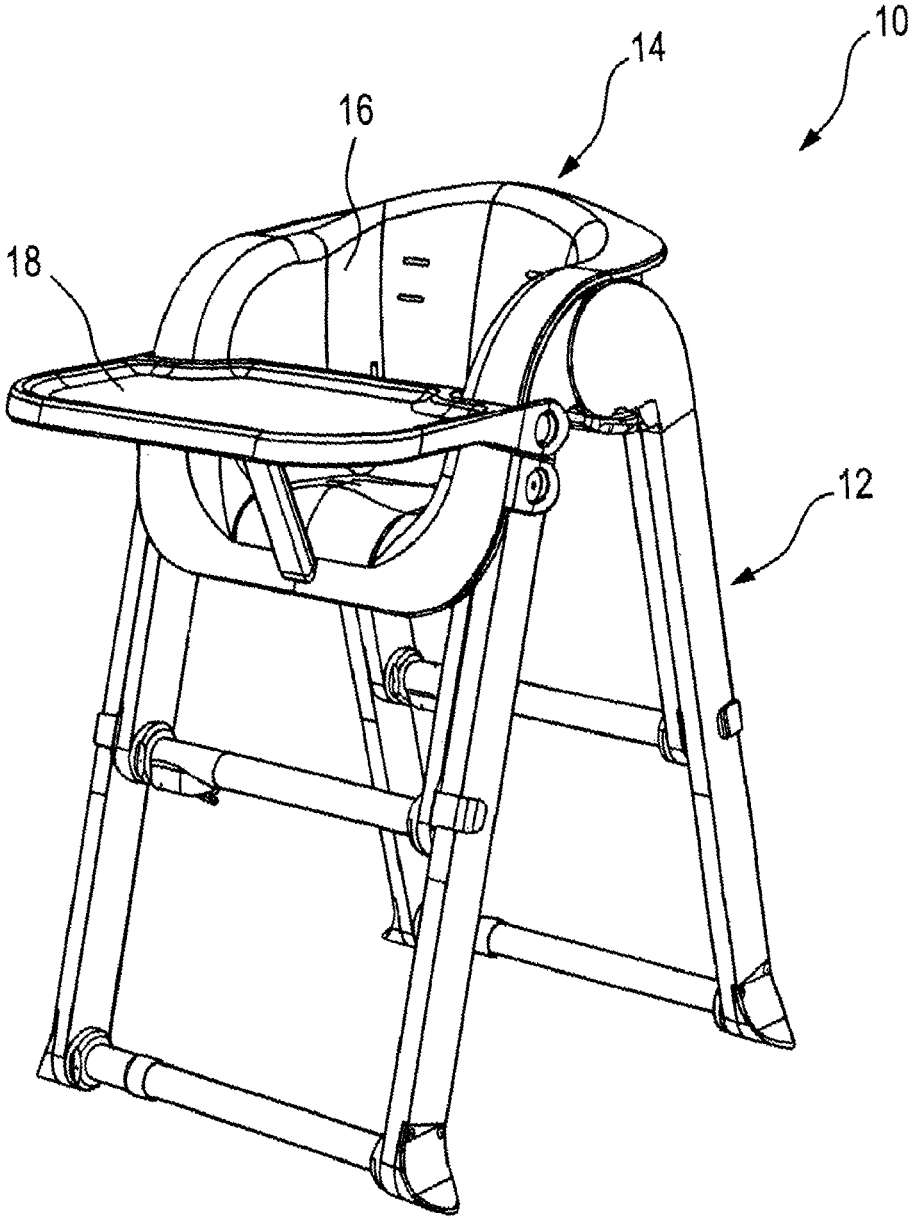
FIG. 1A is a perspective view of the infant seat and crib arrangement of the present invention when the seat is in place.
Figure 1B:
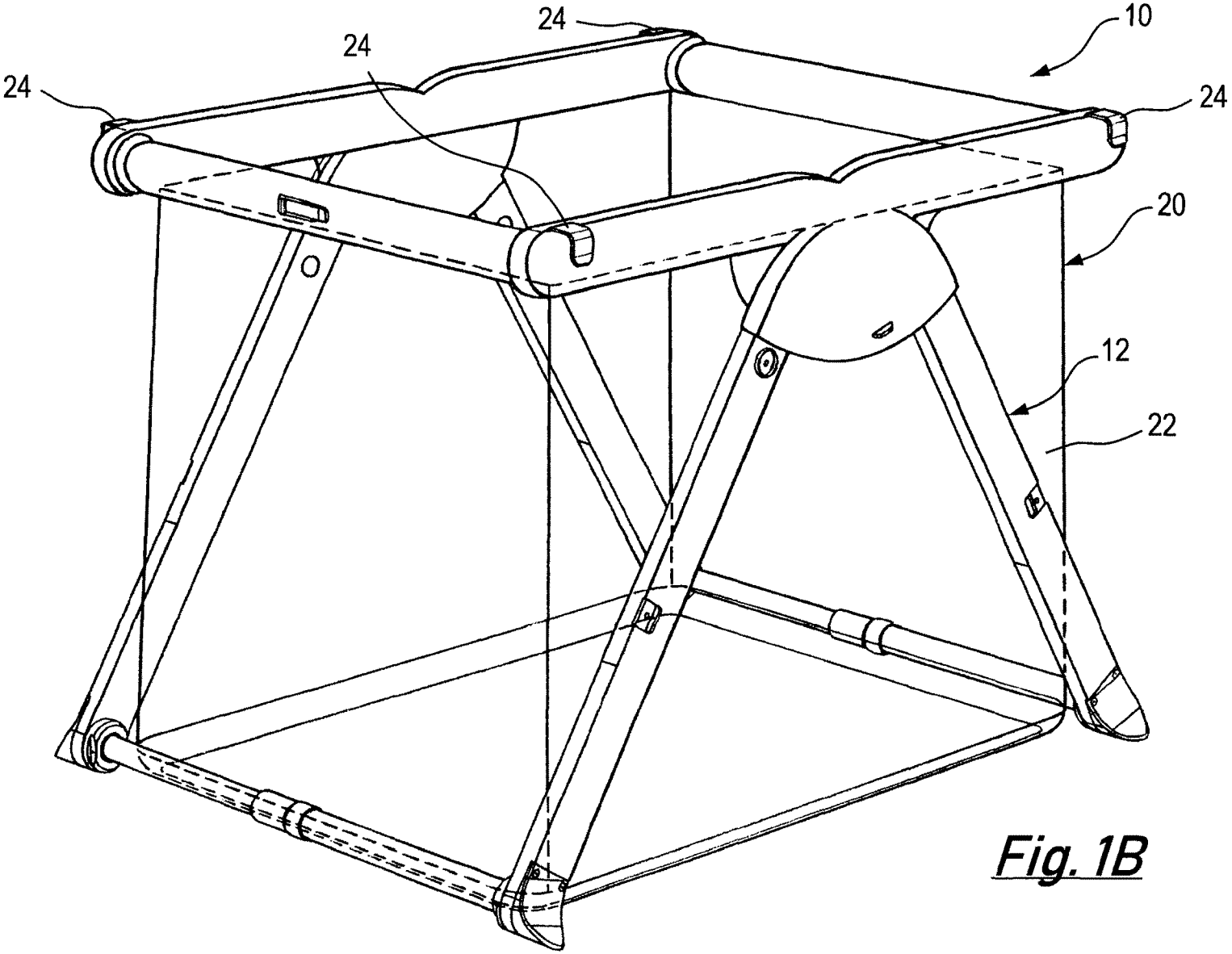
FIG. 1B is a perspective view of the infant seat and crib arrangement of the present invention when the crib is in place.
Figure 1C:
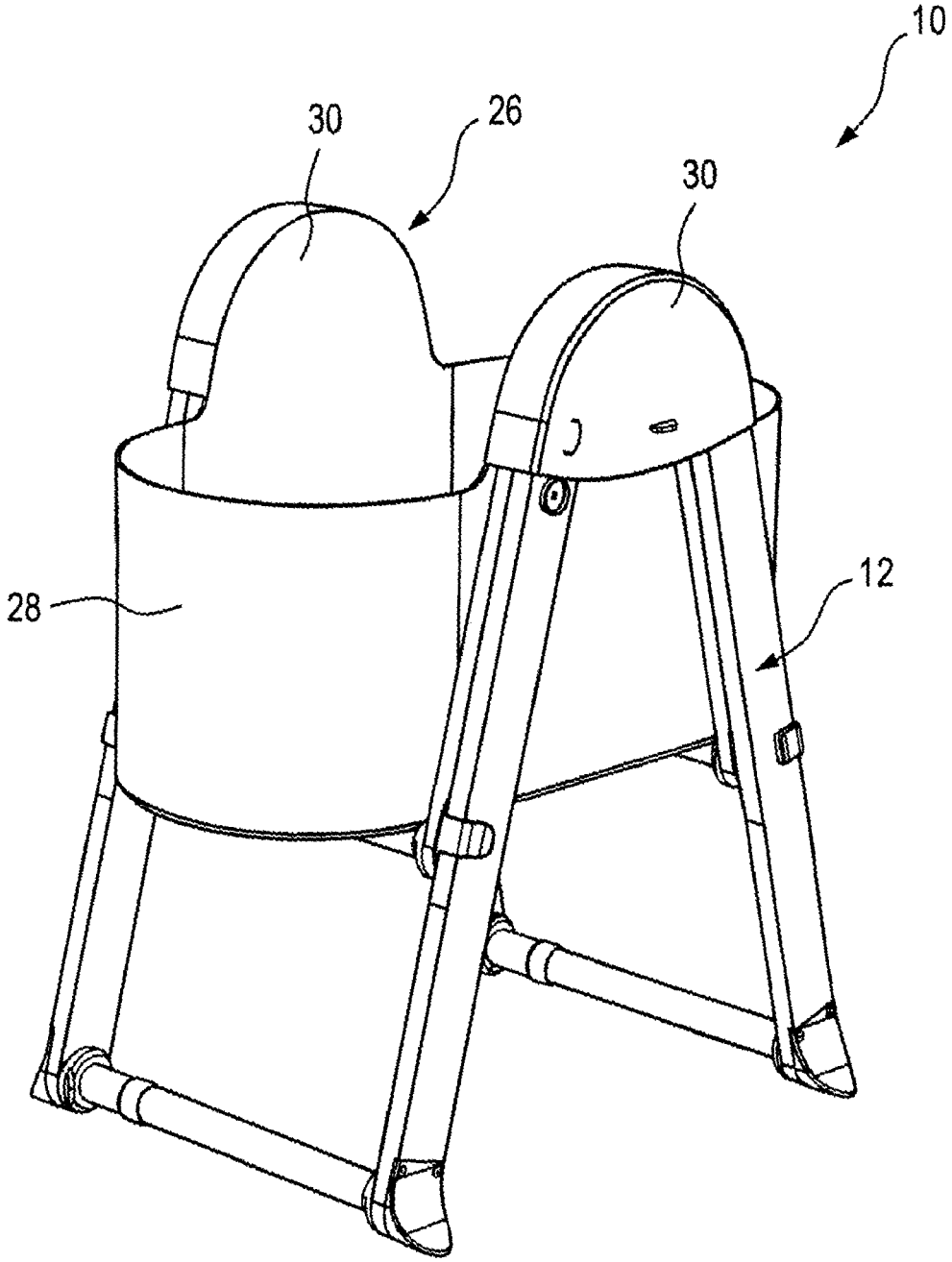
FIG. 1C is a perspective view of the infant seat and crib arrangement of the present invention when the cot is in place.

The infant seat and crib arrangement of the present invention will now be described with reference to FIGS. 1A to 1C. The infant seat and crib arrangement of the present invention comprises a frame, a seat, a crib and a cot with the seat, the crib and the cot being brought into use with the frame at different times. A perspective view of the infant seat and crib arrangement 10 of the present invention is shown in FIG. 1A when the seat is in place. A perspective view of the infant seat and crib arrangement 10 of the present invention is shown in FIG. 1B when the crib is in place. A perspective view of the infant seat and crib arrangement 10 of the present invention is shown in FIG. 1C when the cot is in place. The infant seat and crib arrangement 10 comprises a frame 12 which is shown in each of FIGS. 1A to 1C.

As may be seen from FIG. 1A a seat 14 is attached to the frame 12 when the frame is in a first disposition. The seat 14 comprises a unitary seat body 16 which defines a base, opposing sides and a back. The unitary seat body 16 is substantially rigid and is formed from PC ABS. The seat 14 also comprises a tray 18 which is removably attached to the seat body 16. The tray is substantially rigid and is formed from PC ABS. The seat 14 further comprises lugs, which are attached to the edge of the seat body 16, whereby the seat is attached removably to the frame 12. As may be appreciated from FIG. 1A, the infant seat and crib arrangement is operative as a highchair for an infant when configured as shown in FIG. 1A.

As may be seen from FIG. 1B a crib 20 is attached to the frame 12 when the frame is in a second disposition. The crib 20 comprises a crib body 22. The crib body 22 comprises pliable material such as cloth configured to define a base and sides. The base of the crib is substantially rectangular whereby the sides comprise two pairs of opposing sides which define a volume of rectangular cross-section. The crib 20 further comprises lugs 24, which are attached to the crib body, whereby the crib is attached removably to the frame 12. As may be appreciated from FIG. 1B, the infant seat and crib arrangement is operative as a crib for an infant when configured as shown in FIG. 1B.

As may be seen from FIG. 1C a cot 26 for an infant is attached to the frame 12 when the frame is in the first disposition. The cot 26 for an infant has the form of a Moses basket. The cot 26 comprises a cot body 28. The cot body 28 is formed from cloth. The cot body 28 further comprises rigid members which are disposed therein so as to determine and maintain the shape of the cot body. The cot 26 further comprises two lugs 30 which are integrally formed from cloth with the cot body 28. The lugs 30 are comprised in the cot midway along opposite sides of the cot body and such that each lug extends from a respective upper edge of the cot body. Each lug 30 defines a recess of generally semicircular form which is oriented down a respective side of the cot body. As shown in FIG. 1C, each lug receives a respective apex defined by the frame 12 when in the first disposition whereby the cot is suspended from the frame. Furthermore, when the lugs are fitted properly to the frame, the base of the cot 26 rests on the two spaced apart arm members described below with reference to FIGS. 2A to 2C.

Figure 2B:
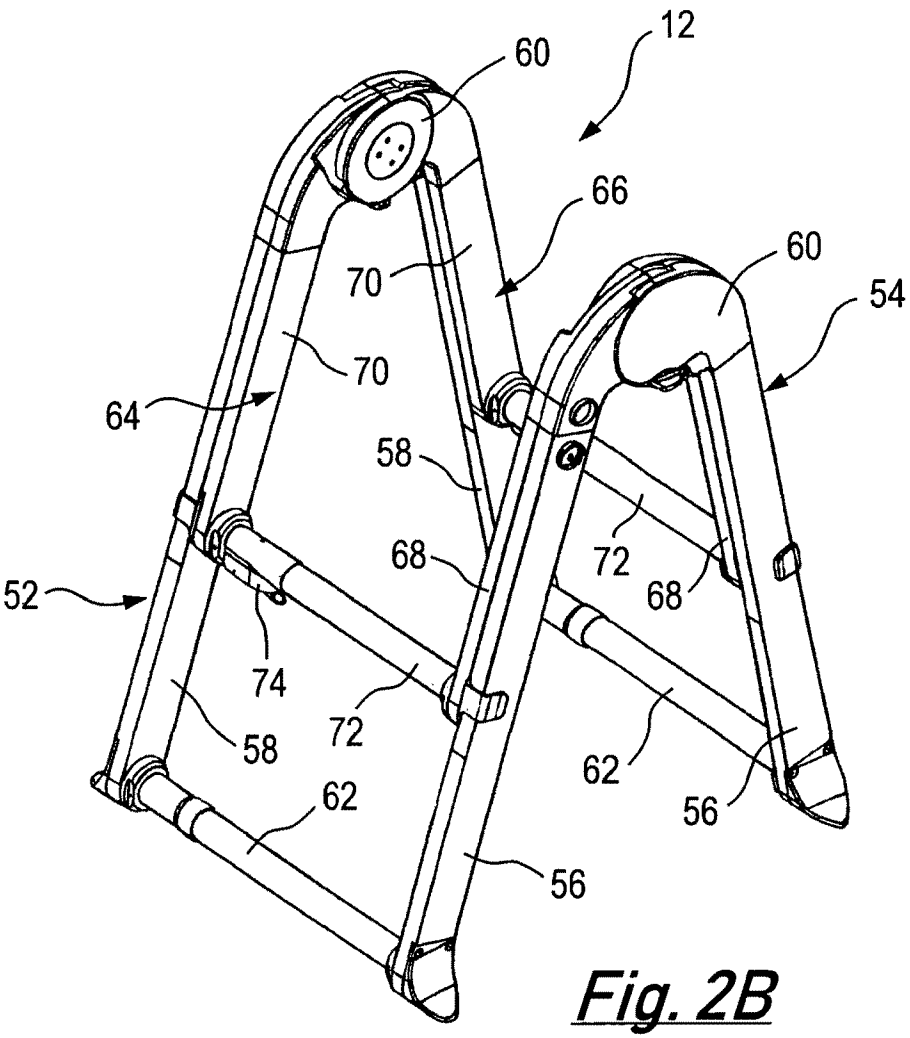
FIG. 2B is a perspective view of the frame of FIG. 2A when in the first disposition.
Figure 2A:
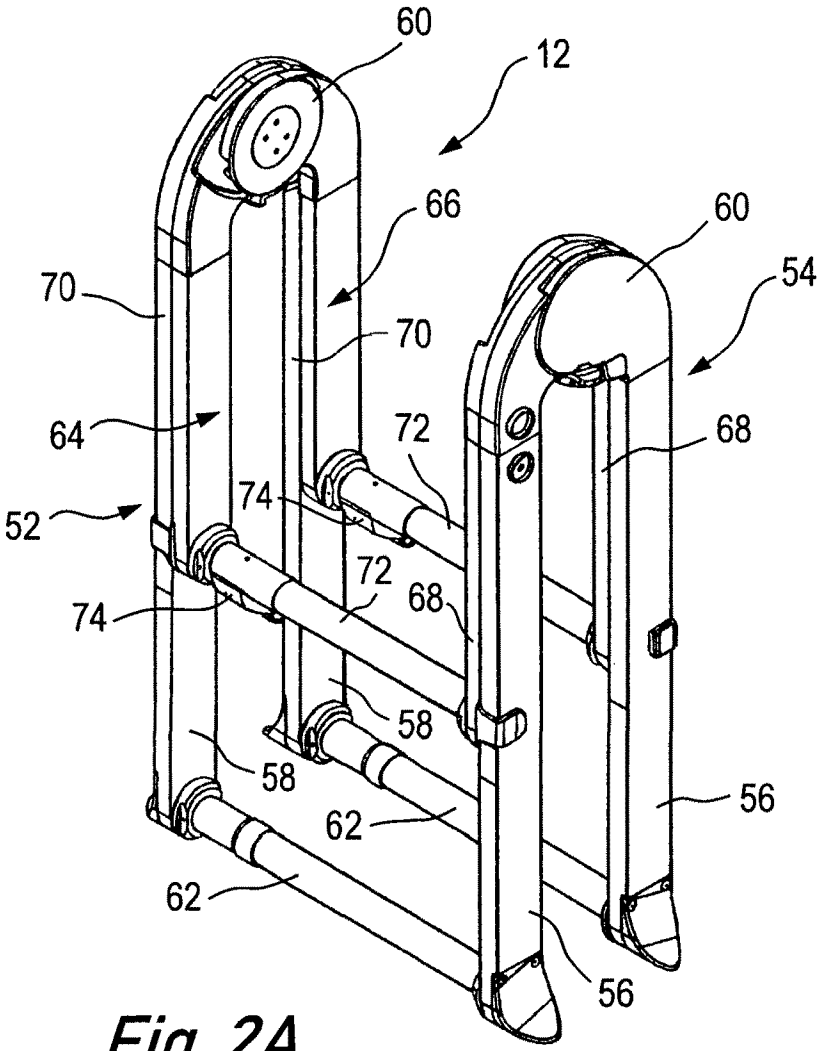
FIG. 2A is a perspective view of the frame of the infant seat and crib arrangement of FIGS. 1A to 1C when in the collapsed disposition.
Figure 2C:
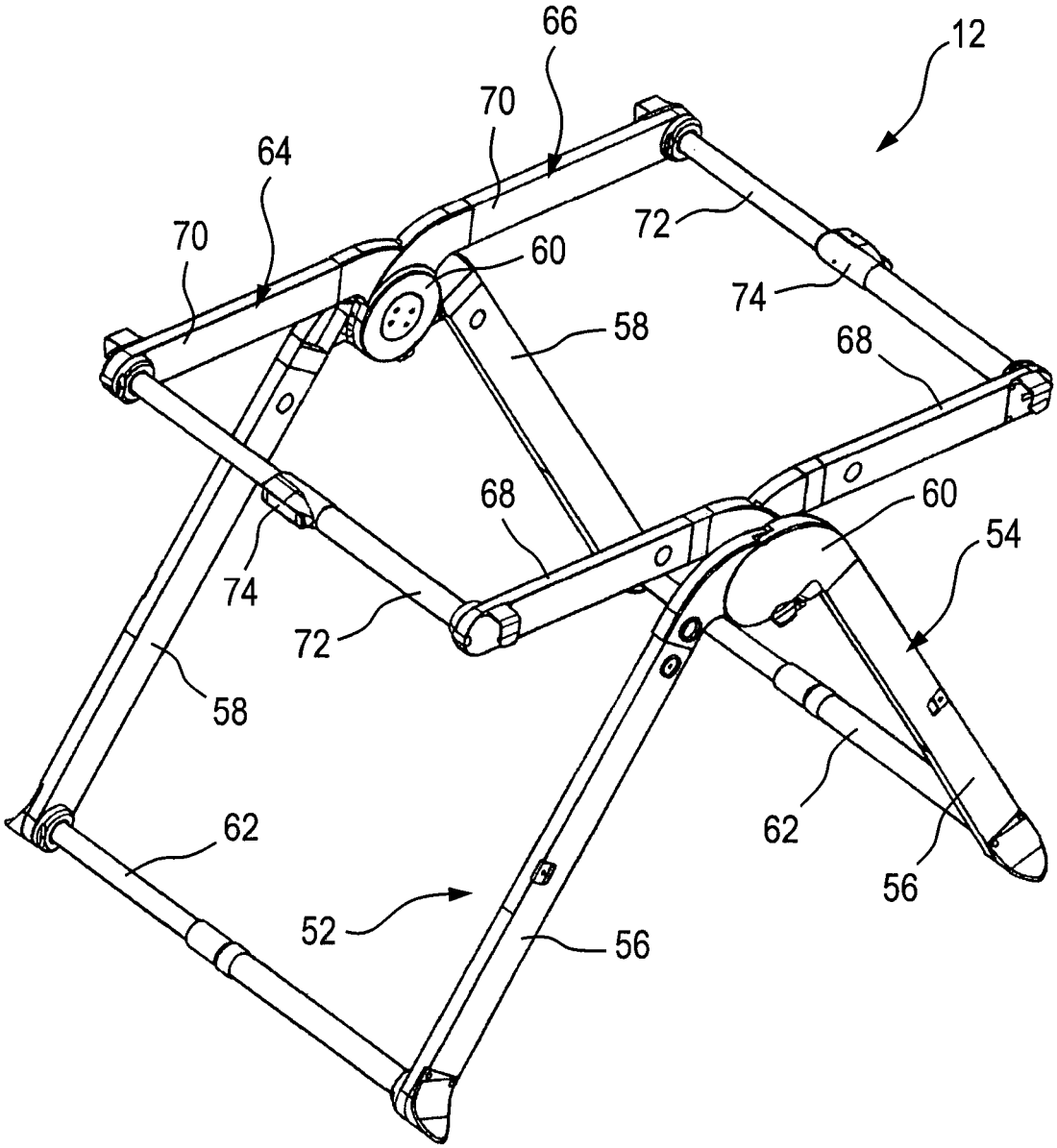
FIG. 2C is a perspective view of the frame of FIGS. 2A and 2B when in the second disposition.

The frame 12 of FIGS. 1A to 1C will now be described in more detail with reference to FIGS. 2A to 2C. FIG. 2A provides a perspective view of the frame 12 of the infant seat and crib arrangement of FIGS. 1A to 1C when in the collapsed disposition. FIG. 2B provides a perspective view of the frame 12 of FIG. 2A when in the first disposition. FIG. 2C provides a perspective view of the frame 12 of FIGS. 2A and 2B when in the second disposition. The frame 12 comprises a first pair of legs 52 and a second pairs of legs 54 with the legs in each pair being spaced apart from each other. The legs are formed from wood. The first legs 56 of the first and second pairs of legs lie in a first plane and define a first side of the frame. The second legs 58 of the first and second pairs of legs lie in a second plane and define a second side of the frame. The first and second planes are substantially parallel and extend substantially orthogonal to a floor on which the frame is supported. A width of the frame 12 is therefore determined by a distance between the first legs 56 and the second legs 58.

The first legs 56 of the first and second pairs of legs are mechanically coupled to each other towards their first proximal ends for relative rotation by way of a hinge 60. Second distal ends of the first legs 56 of the first and second pairs of legs each define a floor supporting surface on an end thereof. The second legs 58 of the first and second pairs of legs are mechanically coupled to each other towards their first proximal ends for relative rotation by way of a hinge 60. Second distal ends of the second legs 58 of the first and second pairs of legs each define a floor supporting surface on an end thereof. The hinges 60 are of the same form and function and are described further below and with reference to FIGS. 3A to 3C.

The first and second legs 56, 58 in each of the first and second pairs of legs 52, 54 are rigidly coupled to each other by an elongate leg member 62 whereby the first and second legs move together. Each elongate leg member 62 is formed from aluminium. Each elongate leg member 62 extends between the first and second legs and attaches to the first and second legs at opposite ends of the leg member.

Furthermore each leg member 62 is attached towards distal ends of the first and second legs. Each leg member 62 is configured for a change in its length whereby a separation between the first legs 56 of each pair and the second legs 58 of each pair is changeable. A width of the frame is thus changeable. Each leg member 62 comprises two cylindrical parts which engage telescopically with each other to thereby provide for length adjustment.

The frame 12 further comprises a first pair of arms 64 and a second pair of arms 66. The arms are formed from wood. Each of the first and second pairs of arms comprises a first arm 68 and a second arm 70. The first arms 68 of the first and second pairs of arms are coupled towards their first proximal ends for relative rotation by way of the hinge 60 that provides for relative rotation of the first legs 56. The second arms 70 of the first and second pairs of arms are coupled for relative rotation towards their first proximal ends by way of the hinge 60 that provides for relative rotation of the second legs 58. The first and second arms 68, 70 in each of the first and second pairs of arms are rigidly coupled to each other by way of an elongate arm member 72 whereby the first and second arms move together. Each arm member 72 is formed from aluminium. Each arm member 72 extends between the first and second arms and attaches to the first and second arms at opposite ends of the arm member. Each arm member 72 is attached towards distal ends of the first and second arms. Each arm member is configured to change its length whereby a separation between the first arms in each pair and the second arms in each pair changeable. A width of the frame 12 is thus changeable when the length of the leg members 62 changes at the same time. Resistance against change in length of each arm member 72 is by way of a lock arrangement 74. The lock arrangement 74 is described below with reference to FIG. 4.

Change in disposition of the legs and arms of the frame 12 will now be described with reference to FIGS. 2A to 2C. The frame 12 is shown in FIG. 2A in the collapsed disposition. When the frame 12 is in the collapsed disposition the first and second pairs of arms 64, 66 are pushed together whereby the first and second pairs of legs 52, 54 are also pushed together by way of lugs attached to the first and second pairs of arms which bear against the first and second pairs of legs. The first and second pairs of arms 64, 66 and the first and second pairs of legs 52, 54 rotate about the hinges 60. When in the collapsed disposition the first pair of arms and first pair of legs are nearby the second pair of arms and the second pair of legs such that first pair of arms and first pair of legs are substantially parallel with the second pair of arms and second pair of legs. As may be seen from FIG. 2A, the frame 12 is configured such that each arm in the first pair of arms 64 is side by side with a respective leg in the first pair of legs 52 whereby the arm is substantially coterminous with the leg in respect of their respective sides and having regard to the arm being shorter than the leg. Furthermore each arm in the first pair of arms 64 is inside its respective leg whereby an outside width of the frame is defined by the legs. Each arm in the second pair of arms 66 is likewise configured such that each arm in the second pair of arms is side by side with a respective leg in the second pair of legs 54 whereby the arm is substantially coterminous with the leg in respect of their respective sides and having regard to the difference in their lengths. Furthermore each arm in the second pair of arms 66 is inside its respective leg.

When it is desired to bring the infant seat and crib arrangement into use, the frame 12 is changed from the collapsed disposition shown in FIG. 2A to either the first disposition shown in FIG. 2B or the second disposition shown in FIG. 2C. The frame 12 is changed from the collapsed disposition by pulling the first and second pairs of arms 64, 66 apart. As described in more detail below with reference to FIGS. 3A to 3C, the hinges 60 are configured such that movement apart of the first and second pairs of arms 64, 66 pulls the first and second pairs of legs 52, 54 apart until the arms and legs have the first disposition shown in FIG. 2B. Each side of the frame 12 therefore defines an A-frame with the apex of the A-frame being furthest from the floor during use of the frame. The first and second pairs of legs 52, 54 are 600 mm apart from each other and the first legs 56 are 533 mm apart from the second legs 58 when the frame is in the first disposition. Then either the seat of FIG. 1A or the cot of FIG. 1C is fitted to the frame 12. When the seat is fitted the top of the back of the seat is 828 mm above a floor on which the frame is supported. When use of the seat or the cot is complete, the seat or cot is removed from the frame 12. The first and second pairs of arms 64, 66 are then pulled further apart. As described in more detail below with reference to FIGS. 3A to 3C, the hinges 60 are configured such that such further movement apart of the first and second pairs of arms 64, 66 pulls the first and second pairs of legs 52, 54 further apart until the legs have the disposition shown in FIG. 2C. Upon yet further movement apart of the first and second pairs of arms 64, 66, the hinges 60 are configured such that the yet further movement apart of the first and second pairs of arms is no longer coupled to the legs whereby the legs remain in the disposition shown in FIG. 2C. The yet further movement apart of the first and second pairs of arms 64, 66 raises the first and second pairs of arms until they extend horizontally from the hinges 60 as shown in FIG. 2C. When the arms are raised such that they extend horizontally, the hinges 60 are configured as described below with reference to FIG. 3A to 3C to maintain the arms in the horizontal position. In addition, the lock arrangement 74 is operated to allow for extension of the arm members 72 and the opposite sides of the frame 12 are pulled apart to increase the width of the frame to the width shown in FIG. 2C. The lock arrangement 74 is then operative to restrict change in length of the arm members whereby the width of the frame is maintained as shown in FIG. 2C. The frame is 715 mm high, the first and second pairs of legs 52, 54 are 983 mm apart from each other and the first legs 56 are 780 mm apart from the second legs 58 when the frame is in the second disposition shown in FIG. 2C. The crib of FIG. 1B is then fitted to the frame 12.

Figure 3A:
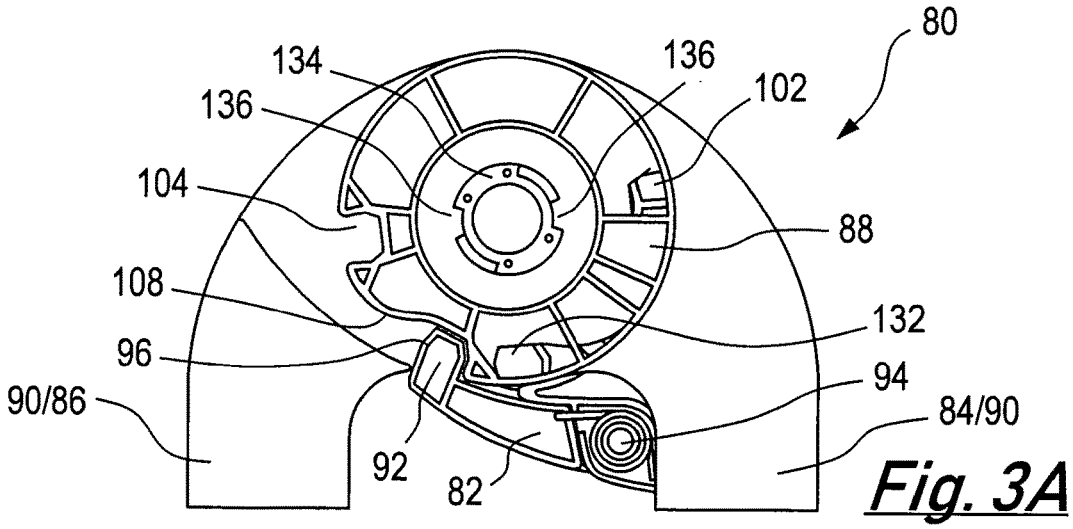
FIG. 3A is a side view of a hinge of the frame when the frame is in the collapsed disposition.
Figure 3B:
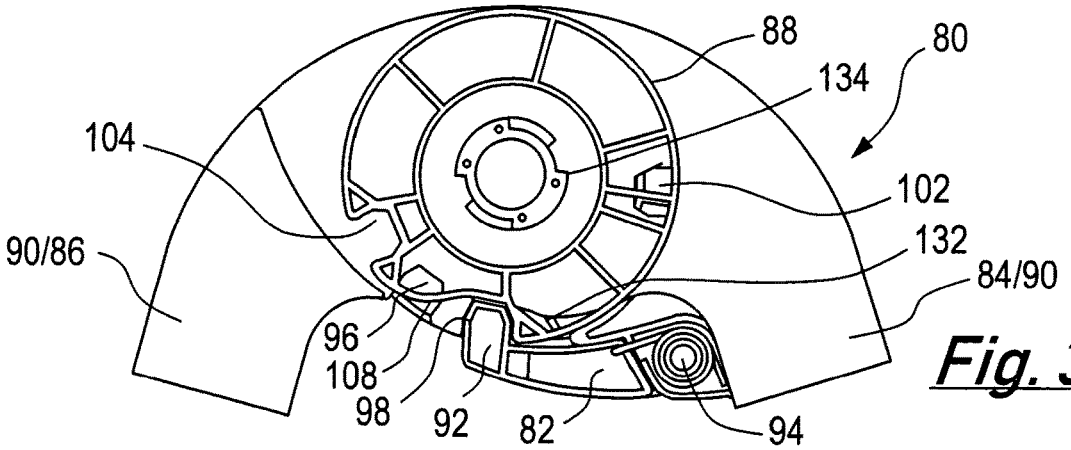
FIG. 3B is a side view of the hinge of FIG. 3A when the frame is in the first disposition.
Figure 3C:
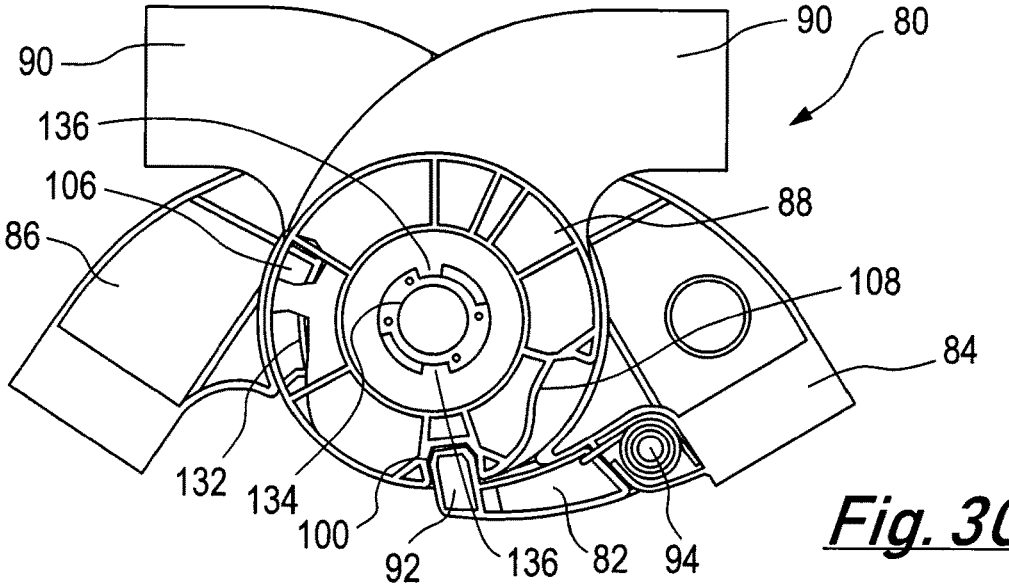
FIG. 3C is a side view of the hinge of FIGS. 3A and 3B when the frame is in the second disposition.

Side views of one of the hinges 60, 80 are shown in FIGS. 3A to 3C. Each hinge 60, 80 is formed from glass filled nylon. FIG. 3A is a side view of the hinge 60, 80 when the frame is in the collapsed disposition. A finger 82 is attached to one of the legs 84 such that it extends towards the other leg 86 and towards a cam arrangement 88 comprised in the hinge. The finger 82 comprises a protrusion 92 which extends laterally from an end of the finger towards the cam arrangement 88. The finger 82 is mounted for rotation on the leg about an axis which is parallel with the axis of rotation of the hinge 80. Furthermore, the finger is biased by a spring 94 towards the cam 88 whereby the protrusion 92 is urged against the periphery of the cam arrangement. The cam arrangement 88 is configured as follows. Each arm and each leg comprises a circular cam portion at its proximal end with the four cam portions being coaxially disposed to thereby form the cam arrangement 88. The leg other than the leg on which the finger 82 is mounted defines a first leg recess 96, a second leg recess 98 and a third leg recess 100. The first to third leg recesses are spaced apart from each other along a circumferential path defined by the leg's cam portion. Each leg recess is shaped to receive the finger protrusion 92. The finger protrusion 92 is received: in the first leg recess 96 when the frame is in the collapsed disposition shown in FIG. 3A; in the second leg recess 98 when the frame is in the first disposition shown in FIG. 3B; and in the third leg recess 100 when the frame is in the second disposition shown in FIG. 3C. The two legs are thus locked to each other when each of the collapsed, first and second dispositions. The arm adjacent the leg mounting the finger 82 defines a first arm recess 102 which is shaped to receive the finger protrusion 92. The first arm recess 102 lies on a circumferential path defined by the arm's cam portion at a location such that the finger protrusion 92 is received in the first arm recess when the frame is in the second disposition shown in FIG. 3C. The other arm defines a second arm recess 104 which is shaped to receive the finger protrusion 92. The second arm recess 104 lies on a circumferential path defined by the arm's cam portion at a location such that the finger protrusion 92 is received in the second arm recess when the frame is in the second disposition shown in FIG. 3C. Each of the two arms is thus locked to the leg mounting the finger 82 when the frame is in the second disposition. The other arm, i.e. the arm other than the arm adjacent the leg mounting the finger 82, defines a third arm recess 106 which is shaped to receive the finger protrusion 92. The third arm recess 106 lies on a circumferential path defined by the arm's cam portion at a location such that the finger protrusion 92 is received in the third arm recess when the frame is in the collapsed disposition shown in FIG. 3A. The other arm is thus locked to the leg mounting the finger 82 when the frame is in the collapsed disposition.

Release of the finger protrusion 92 from arm or leg recesses to allow for change of the frame between dispositions is by manual movement of the finger 82 against the bias of the spring 94. Alternatively, the finger protrusion 92 is released by manual movement of the arms and without manual movement of the legs. The arm adjacent the leg mounting the finger 82 defines a first arm profile 108 on the circumferential path of the arm and which receives the finger protrusion 92 when the frame is in the collapsed disposition. The first arm profile 108 is shaped to push the finger progressively away against the spring bias as the arm is raised whereby the finger protrusion 92 is released from the first leg recess 96. The other arm defines second arm profile 132 on the circumferential path of the arm and which receives the finger protrusion 92 when the frame is in the first disposition. The first arm profile 132 is shaped to push the finger progressively away against the spring bias as the arm is raised whereby the finger protrusion 92 is released from the second leg recess 98.

Manual movement of the arms 90 without the legs as described above causes movement of the legs 84, 86 by the following two mechanisms. According to the first mechanism, the leg 86 other than the leg mounting the finger 82 defines a channel (not shown) which describes an arc. The arm 90 adjacent the leg 86 defines a protrusion (not shown) which extends in the same direction as the axis of rotation of the hinge and which is received in the channel with the channel and protrusion being shaped and disposed such that the protrusion travels along the channel as the arm 90 is moved in relation to the leg 86. More specifically the channel and protrusion are shaped and disposed to allow for the arm 90 to be lifted from the position shown in FIG. 3A until the arm reaches an angle of 75 degrees. At this point, the protrusion reaches the end of the channel and the leg 86 is rotated with the arm 90. According to the second mechanism, the leg 84 mounting the finger 82 comprises a spigot 134 which is coaxial with the axis of rotation of the hinge. The adjacent arm 90 defines a spigot aperture which receives the spigot 134. The surface which defines the spigot aperture has two opposing spigot aperture protrusions 136 extending therefrom. The surface of the spigot 134 facing the surface defining the spigot aperture has two oppositely directed spigot protrusions extending therefrom at locations such that each spigot protrusion is received between the spigot aperture protrusions 136. The circumferential length of the spigot protrusions and the spigot aperture protrusions 136 is such that spigot protrusions travel along the space between the spigot aperture protrusions as the arm is lifted from the position shown in FIG. 3A until the arm reaches an angle of 75 degrees. At this point, an end of each of the spigot protrusions abuts against a respective spigot aperture protrusion whereby further lifting of the arm causes the leg to move with the arm. The two mechanisms thus mechanically couple lifting of one arm to its respective leg and mechanically couple lifting of the other arm to its respective leg.

As described above, there is a hinge 60 at each of the two sides of the frame 12. Each of the two hinges 60 is comprised in the frame such that it is mirrored relative to the other hinge whereby there is reversal in respect of which arms and legs on each side of the hinges the coupling mechanisms are operative.

Figure 4:
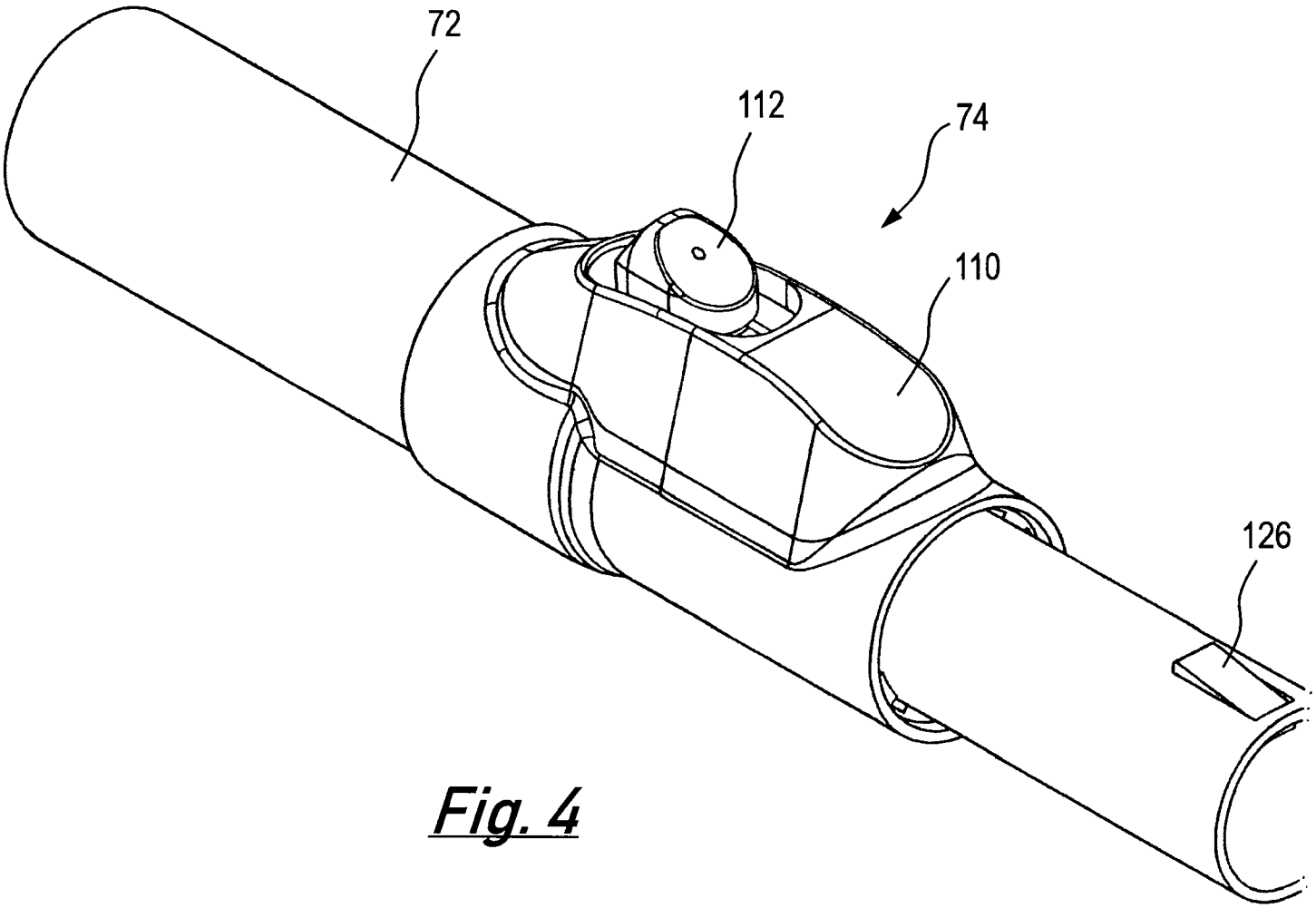
FIG. 4 is a perspective view of an arm member and lock arrangement.

A perspective view of an arm member 72 and the lock arrangement 74 is shown in FIG. 4. As can be seen from FIG. 4, the lock arrangement 74 is mounted on the outside of the first part of the arm member 72 which telescopically receives the second part of the arm member. The lock arrangement 74 comprises a housing 110 attached to the first part of the arm member 72 and a user operable slider 112 mounted on the housing for movement in a direction along the length of the arm member. The slider 112 is operated by a user to control the lock arrangement 74. Operation of the lock arrangement 74 of FIG. 4 will now be described with reference to FIGS. 5A to 5E which provide different views in longitudinal section through the lock arrangement and arm member 72 of FIG. 4.

Figure 5A:
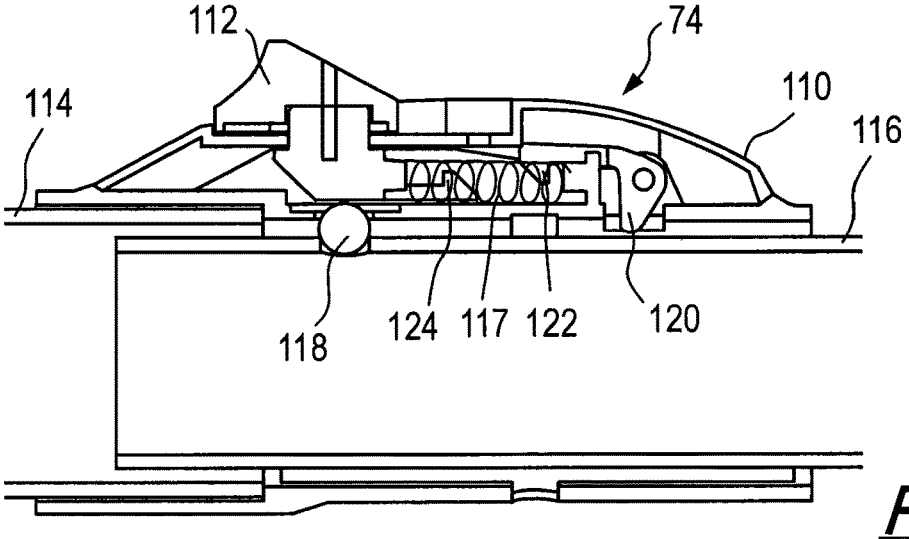
FIGS. 5A to 5E illustrate operation of the lock arrangement of FIG. 4.

FIG. 5A shows the lock arrangement 74 when the first part 114 of the arm member and the second part 116 of the arm member are locked against their relative longitudinal movement when in the second disposition. The lock arrangement 74 further comprises a spring 117 and a ball bearing 118 within the housing 110. The spring 117 biases the slider 112 in the direction of the first part 114 to thereby maintain the lock arrangement in a locked condition. The ball bearing 118 is supported in a first aperture in the first part 114 for movement towards and away from the second part 116. The second part 116 defines a second aperture which is configured to receive the ball bearing 118 in part. As shown in FIG. 5A when the first and second parts 114, 116 are disposed relative to each other such that the first and second apertures are in registration, a surface of the slider 112 oriented towards the second part 116 bears against the ball bearing 118 whereby the ball bearing is forced through the first aperture towards the second part such that part of the ball bearing is received in the second aperture. The ball bearing 118 is thus received in both first and second apertures whereby the first and second parts 114, 116 are locked against relative longitudinal movement.

Figure 5B:
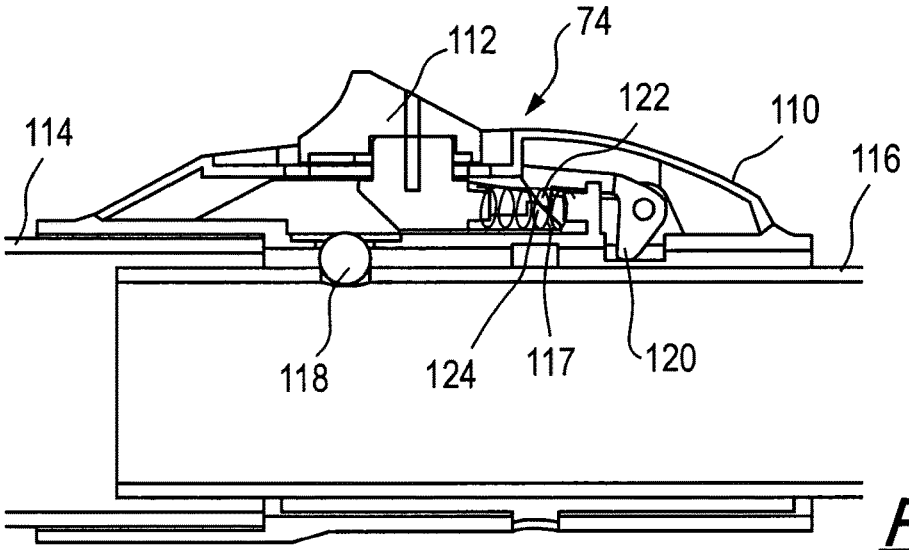

When it is desired to unlock the first and second parts 114, 116, for example when changing from the second disposition to the first disposition, the user moves the slider 112 against the bias of the spring 117 towards the second part 116 as shown in FIG. 5B. The surface of the slider 112 which is oriented towards the second part 116 now longer bears against the ball bearing 118 whereby the ball bearing is free to move away from the second part such that it is no longer in the second aperture. The first and second parts 114, 116 are therefore no longer locked together by the ball bearing whereby the first and second parts are movable in relation to each other. The lock arrangement 74 further comprises a latch 120 which is mounted for rotation inside the housing 110 at an end of the housing along the arm member opposite the end of the housing which holds the slider 112 when the lock arrangement is in the condition shown in FIG. 5A. A distal end of the latch defines a first projection 122 with the latch being rotatable such that the distal end of the latch is raised or lowered. A distal end of the slider 112 which is oriented towards the latch 120 defines a second projection 124. The first and second projections 122, 124 are shaped such that as the slider 112 is moved to the location shown in FIG. 5B the second projection 124 bears against the first projection 122 and with progressive further movement of the slider raises the distal end of the latch 120.

Figure 5C:
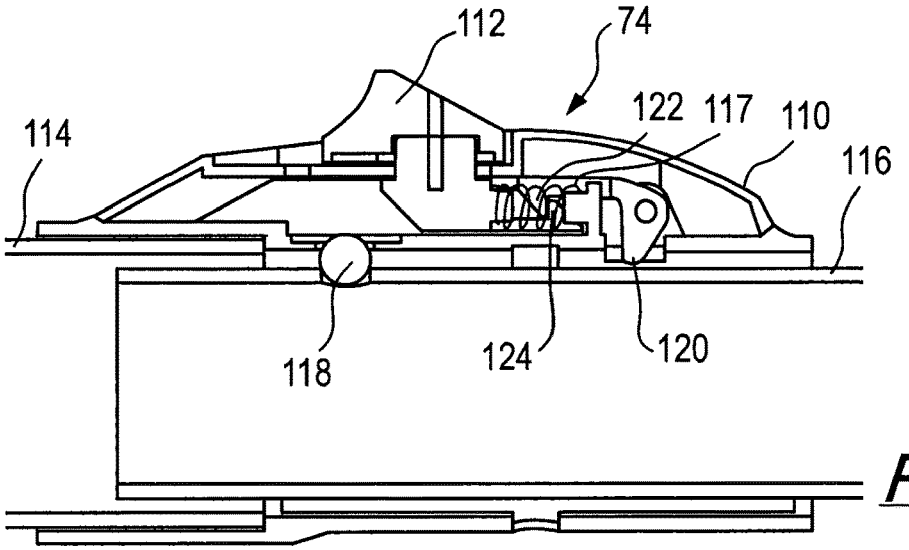
Figure 5D:
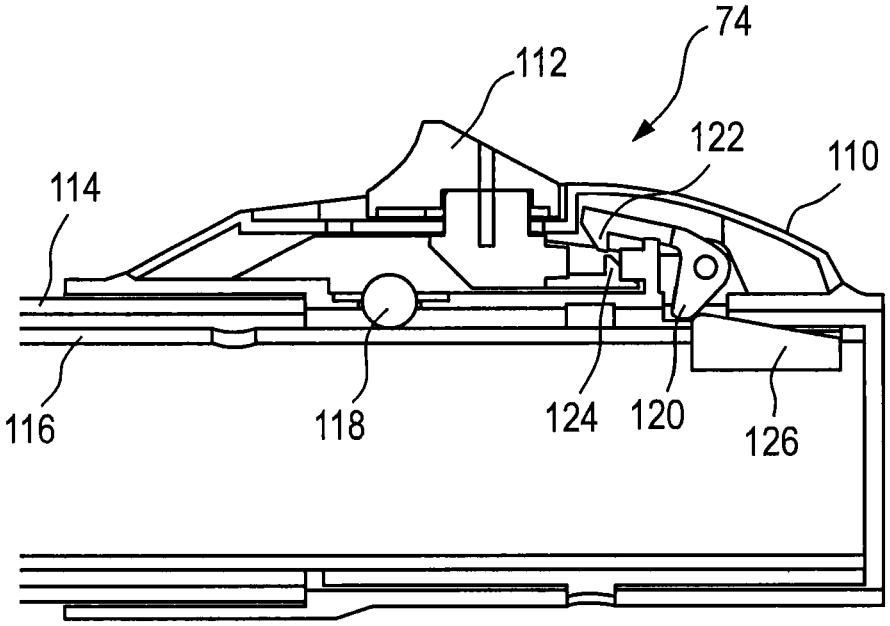
Figure 5E:
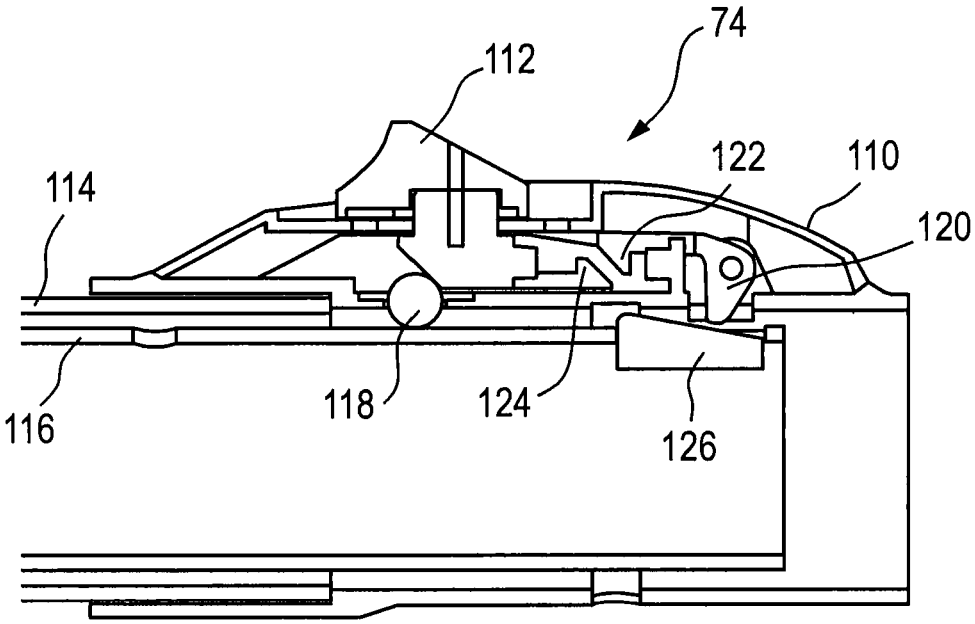

When the slider 112 has been moved against the bias of the spring 117 to its furthest extent the distal end of the slider has been moved relative to the distal end of the latch 120 such that the first protrusion 122 has moved beyond the second protrusion 124. When the first protrusion 122 has moved beyond the second protrusion 124 the latch 120 rotates such that first protrusion 122 drops down behind the second protrusion 124 as shown in FIG. 5C. Although not shown in FIG. 5C, a torsion spring is operative to urge the distal end of the latch downwards. When the lock arrangement 74 is in the condition shown in FIG. 5C and when the user has released the slider, engagement of the first and second protrusions 122, 124 presents resistance to movement of the slider 112 caused by the bias of the spring 117. Engagement of the first and second protrusions 122, 124 therefore keeps the lock arrangement 74 unlocked in the absence of user operation of the slider. The first and second parts 114, 116 are then moved relative to each other such that the second part is progressively further received within the first part, such as happens when changing from the second disposition to the first disposition, until a surface of a proximal part of the latch which is oriented towards the second part bears against a latch release 126 which is mounted on the second part such that it protrudes from the second part. The latch release 126 is shown in FIG. 4. The latch release 126 and the surface of the proximal part of the latch 120 which is oriented towards the second part 116 are shaped such that their relative movement raises the distal end of the latch whereby the first and second protrusions 122, 124 disengage from each other as shown in FIG. 5D. The slider 112 then moves under the bias of the spring (not shown in FIGS. 5D and 5E for clarity) back towards the ball bearing 118. The surface of the slider 112 which is oriented towards the second part 116 now bears again against the ball bearing 118 as shown in FIG. 5E. However because the first and second apertures are no longer in registration the ball bearing 118 is not operative to lock the first and second parts 114, 116 together. Upon withdrawal of the second part 116 from the first part 114 when changing back to the second disposition such that the arm member is lengthened to the extent that the first and second apertures are in registration, the ball bearing 118 is forced again into the second aperture by the slider 112 to thereby put the arm member back in the locked condition shown in FIG. 5A.

The invention claimed is:

1. An infant seat and crib arrangement comprising:

a seat configured to support an infant in a sitting position;

a crib configured to enclose an infant, the crib and the seat separate from each other; and a frame configured to support the seat or crib in a position of use above a support surface and configured for change between a first disposition in which the seat engages removably with the frame to thereby bring the seat into use and a second disposition in which the crib removably engages with the frame after removal of the seat from the frame to thereby bring the crib into use, wherein the frame comprises first and second pairs of legs and first and second pairs of arms, the first pair of arms being adjacent the first pair of legs and the second pair of arms being adjacent the second pair of legs, a space for receiving the seat or the crib being defined between the first pair of legs and the second pair of legs and being adjacent to and bounded by part of the legs, wherein the seat or crib is received in part between the first and second pairs of legs in the position of use with distal ends of the first and second pair of legs adapted to contact the support surface, wherein the frame is configured for relative rotation of the arms in each of the first and second pairs of arms whereby distal ends of the arms in each pair are spaced apart further from each other in the second disposition than in the first disposition, and wherein, in the first and second dispositions, proximal ends of the legs in the first pair of legs are adjoining to form a first apex such that the legs in the first pair of legs slope away from the first apex, proximal ends of the legs in the second pair of legs are adjoining to form a second apex such that the legs in the second pair of legs slope away from the second apex, the arms in the first pair of arms extend away from the first apex, and the arms in the second pair of arms extend away from the second apex.

2. The infant seat and crib arrangement according to claim 1 wherein the arms in each of the first and second pairs of arms define an acute angle between each other when in the first disposition and extend substantially in a line when in the second disposition.

3. The infant seat and crib arrangement according to claim 1 wherein, in the first disposition, the arms in the first pair of arms slope away from the first apex in alignment with the first pair of legs and the arms in the second pair of arms slope away from the second apex in alignment with the second pair of legs, and wherein, in the second disposition, the arms in the first pair of arms extend in substantially opposite directions from the first apex and the arms in the second pair of arms extend in substantially opposite directions from the second apex.

4. The infant seat and crib arrangement according to claim 1 wherein the arms of the first and second pairs of arms opposing each other across the seat or crib receiving space are attached to each other by a respective elongate arm member.

5. The infant seat and crib arrangement according to claim 4 wherein the legs of the first and second pairs of legs opposing each other across the seat or crib receiving space are attached to each other by a respective elongate leg member, each elongate arm member and each elongate leg member being extensible.

6. The infant seat and crib arrangement according to claim 1 wherein the frame comprises first and second hinges, the first hinge being at the first apex and providing for relative rotation of the arms in the first pair of arms and the second hinge being at the second apex and providing for relative rotation of the arms in the second pair of arms.

7. The infant seat and crib arrangement according to claim 6 wherein the frame is configured such that the first hinge provides for relative rotation of the legs in the first pair of legs and the second hinge provides for relative rotation of the legs in the second pair of legs whereby the distal ends of the legs in each pair of legs are spaced apart further from each other when in the second disposition than when in the first disposition.

8. The infant seat and crib arrangement according to claim 6 wherein the frame comprises a locking device which is operative to releasably hold the frame in each of the first and second dispositions, the locking device comprising two recesses and a protrusion which is biased to be received in each of the two recesses, the two recesses being spaced apart on a part of one of the first and second hinges, the protrusion being mounted on one of the arms in a respective one of the first and second pairs of arms or on one of the legs in a respective one of the first and second pairs of legs, rotation about the first and second hinges between the first and second dispositions causing movement of the two recesses relative to the protrusion whereby the protrusion is received in one of the two recesses in the first disposition and is received in the other of the two recesses in the second disposition.

9. The infant seat and crib arrangement according to claim 1, wherein the frame comprises a hinge arrangement, the frame changeable between the first and second dispositions by way of the hinge arrangement.

10. The infant seat and crib arrangement according to claim 1 wherein each of the first and second pairs of arms comprises a first arm and a second arm, the two first arms are coupled to each other by a first elongate arm member and the two second arms are coupled to each other by a second elongate arm member whereby movement of one of the two first arms between the first and second dispositions causes corresponding movement of the other of the two first arms, and movement of one of the two second arms between the first and second dispositions causes corresponding movement of the other of the two second arms.

11. The infant seat and crib arrangement according to claim 10 wherein each of the first and second elongate arm members attaches at opposite ends of the elongate arm member towards distal ends of the respective ones of: the two first arms; and the two second arms.

12. The infant seat and crib arrangement according to claim 11 wherein each of the first and second elongate arm members is configured to change its length whereby a separation between the first and second pairs of arms is changed to thus change a width of the frame.

13. The infant seat and crib arrangement according to claim 1 further comprising a cot for an infant, the frame configured to support the cot such that the cot is adapted to be spaced apart from a floor on which the frame is supported.

14. The infant seat and crib arrangement according to claim 1 wherein the seat comprises a unitary seat body defining a base, opposing sides and a back, the base, opposing sides and the back defining an infant receiving space, the seat further comprising attachment members attached to the seat body which are configured to engage with the frame to thereby attach the seat body to the frame.

15. The infant seat and crib arrangement according to claim 1 wherein the crib comprises a crib body, the crib body comprising a pliable material defining a substantially rectangular base and substantially rectangular sides.

16. The infant seat and crib arrangement according to claim 1 wherein in the position of use, the first pair of arms are laterally adjacent the first pair of legs and the second pair of arms are laterally adjacent the second pair of legs, and the seat or crib is positioned with the first pair of legs and the second pair of legs laterally adjacent to opposing lateral sides of the seat or crib, and wherein lateral is in a direction generally parallel to the support surface.

17. An infant seat and crib arrangement, comprising:

a seat configured to support an infant in a sitting position;

a crib configured to enclose an infant, the crib and the seat separate from each other; and a frame configured for change between a first disposition in which the seat engages removably with the frame to thereby bring the seat into use and a second disposition in which the crib removably engages with the frame after removal of the seat from the frame to thereby bring the crib into use, wherein the frame comprises first and second pairs of legs and first and second pairs of arms, the first pair of arms being adjacent the first pair of legs and the second pair of arms being adjacent the second pair of legs, a space for receiving the seat or the crib being defined between the first pair of legs and the second pair of legs, wherein the frame is configured for relative rotation of the arms in each of the first and second pairs of arms whereby distal ends of the arms in each pair are spaced apart further from each other in the second disposition than in the first disposition, wherein, in the first and second dispositions, proximal ends of the legs in the first pair of legs are adjoining to form a first apex such that the legs in the first pair of legs slope away from the first apex, proximal ends of the legs in the second pair of legs are adjoining to form a second apex such that the legs in the second pair of legs slope away from the second apex, the arms in the first pair of arms extend away from the first apex, and the arms in the second pair of arms extend away from the second apex, and wherein the first and second pairs of arms are coupled for rotation relative to the rest of the frame between: a first arm disposition in which the arms of the first and second pairs of arms are adapted to extend obliquely towards a floor on which the frame is supported and when the frame is in the first disposition; and a second arm disposition in which the arms of the first and second pairs of arms are adapted to extend generally parallel to the floor when the frame is in the second disposition.

18. An infant seat and crib arrangement, comprising:

a seat configured to support an infant in a sitting position;

a crib configured to enclose an infant, the crib and the seat separate from each other; and a frame configured for change between a first disposition in which the seat engages removably with the frame to thereby bring the seat into use and a second disposition in which the crib removably engages with the frame after removal of the seat from the frame to thereby bring the crib into use, wherein the frame comprises first and second pairs of legs and first and second pairs of arms, the first pair of arms being adjacent the first pair of legs and the second pair of arms being adjacent the second pair of legs, a space for receiving the seat or the crib being defined between the first pair of legs and the second pair of legs, wherein the frame is configured for relative rotation of the arms in each of the first and second pairs of arms whereby distal ends of the arms in each pair are spaced apart further from each other in the second disposition than in the first disposition, wherein, in the first and second dispositions, proximal ends of the legs in the first pair of legs are adjoining to form a first apex such that the legs in the first pair of legs slope away from the first apex, proximal ends of the legs in the second pair of legs are adjoining to form a second apex such that the legs in the second pair of legs slope away from the second apex, the arms in the first pair of arms extend away from the first apex, and the arms in the second pair of arms extend away from the second apex, and wherein the first pair of legs lies in a first plane and the second pair of legs lies in a second plane, the first and second planes substantially parallel to each other, and each of the first and second planes extends adapted to extend generally orthogonal to a plane of a floor on which the frame is supported.

* * * * *